US012716116B2

(12) United States Patent
Kainuma et al.

(10) Patent No.: US 12,716,116 B2
(45) Date of Patent: Aug. 25, 2026

(54) Co-BASED SUPERELASTIC ALLOY MATERIALS, PLATE MATERIALS AND WIRE MATERIALS COMPRISING Co-BASED SUPERELASTIC ALLOY MATERIALS, Co-BASED SUPERELASTIC ALLOY MATERIALS MANUFACTURING METHODS, STENTS, GUIDE WIRES, AND HIP IMPLANTS

(71) Applicant: TOHOKU UNIVERSITY, Sendai (JP)

(72) Inventors: Ryosuke Kainuma, Sendai (JP); Toshihiro Omori, Sendai (JP); Xiao Xu, Sendai (JP); Takumi Odaira, Sendai (JP)

(73) Assignee: TOHOKU UNIVERSITY, Sendai (JP)

( * ) Notice: Subject to any disclaimer, the term of this patent is extended or adjusted under 35 U.S.C. 154(b) by 409 days.

(21) Appl. No.: 18/571,501

(22) PCT Filed: Mar. 15, 2022

(86) PCT No.: PCT/JP2022/011653
§ 371 (c)(1),
(2) Date: Dec. 18, 2023

(87) PCT Pub. No.: WO2022/270045
PCT Pub. Date: Dec. 29, 2022

(65) Prior Publication Data

US 2024/0287651 A1 Aug. 29, 2024

(30) Foreign Application Priority Data

Jun. 23, 2021 (JP) ..... 2021-104095

(51) Int. Cl.
*C22C 19/07* (2006.01)
*C22C 30/00* (2006.01)
(Continued)

(52) U.S. Cl.
CPC ..... *C22C 19/07* (2013.01); *C22F 1/002* (2013.01); *C22F 1/10* (2013.01)

(58) Field of Classification Search
CPC ..... C22C 19/07; C22C 30/00; C22F 1/006; C22F 1/10
See application file for complete search history.

(56) References Cited

U.S. PATENT DOCUMENTS 4,503,122 A 3/1985 Nicoll
2015/0045695 A1* 2/2015 Simpson ..... B23K 20/002 228/101

FOREIGN PATENT DOCUMENTS

JP S59118847 A 7/1984
JP 6490608 B2 3/2019

OTHER PUBLICATIONS

PCT International Search Report (with English translation) for corresponding PCT Application No. PCT/JP2022/011653, mailed May 31, 2022, 6 pages.
(Continued)

*Primary Examiner* — Jessee R Roe
(74) *Attorney, Agent, or Firm* — Dority & Manning, P.A.

(57) ABSTRACT

A Co-based superelastic alloy material contains a Co—Cr—Al—Si-based alloy and has a composition (at. %) within a pentagon area on the Co—Cr—(Al,Si) pseudo-ternary phase diagram, and containing Al: 2.5 at. % to 10.0 at. % and Si: 2.5 at. % to 13.0 at. %, the pentagon area being formed of five points of point A: $Co_{49.5}Cr_{27.5}(Al,Si)_{23}$, point B: $Co_{57}Cr_{27.5}(Al,Si)_{13.5}$, point C: $Co_{50}Cr_{45}(Al,Si)_5$, point D: $Co_{45}Cr_{45}(Al,Si)_{10}$, and point E: $Co_{45}Cr_{32}(Al,Si)_{23}$.

15 Claims, 9 Drawing Sheets

(51) Int. Cl.
*C22F 1/00* (2006.01)
*C22F 1/10* (2006.01)

(56) References Cited

OTHER PUBLICATIONS

Hirata et al., "Martensitic transformation and superelasticity in off-stoichiometric Co2Cr(AlSi) Heusler alloys", Journal of Alloys and Compounds, vol. 642, 2015, pp. 200-203.
Hirata et al., "Phase stability and magnetic properties in Co2Cr(Al,Si) shape memory alloys", Journal of Magnetism and Magnetic Materials, vol. 500, 2020, 6 pages.
Kurihara, et al., "Abnormal Grain Growth induced by cyclic heat treatment in Co—Cr—Al—Si alloys" (with PowerPoint for presentation), The Japan Institute of Metals and Materials, vol. 272, 2021, 49 pages.
Odaira et al., "Elastocaloric switching effect induced by reentrant martensitic transformation", Applied Physics Review, Rev. 7, 031406, 2020, 11 pages.
Odaira et al., "Superelasitic properties at cryogenic temperatures in Co—Cr—Al—Si shape memory alloys", The 6$^{th}$ International Conference on Ferromagnetic Shape Memory Alloys, Prague, Czech Republic, Jun. 2-7, 2019, 6 pages.
Odaira et al., "Thermal, magnetic field- and stress-induced transformation in Heusler-type Co—Cr—Al—Si shape memory alloys", Scripta Materialia, vol. 153, 2018, pp. 35-39.

* cited by examiner

[FIG. 1]
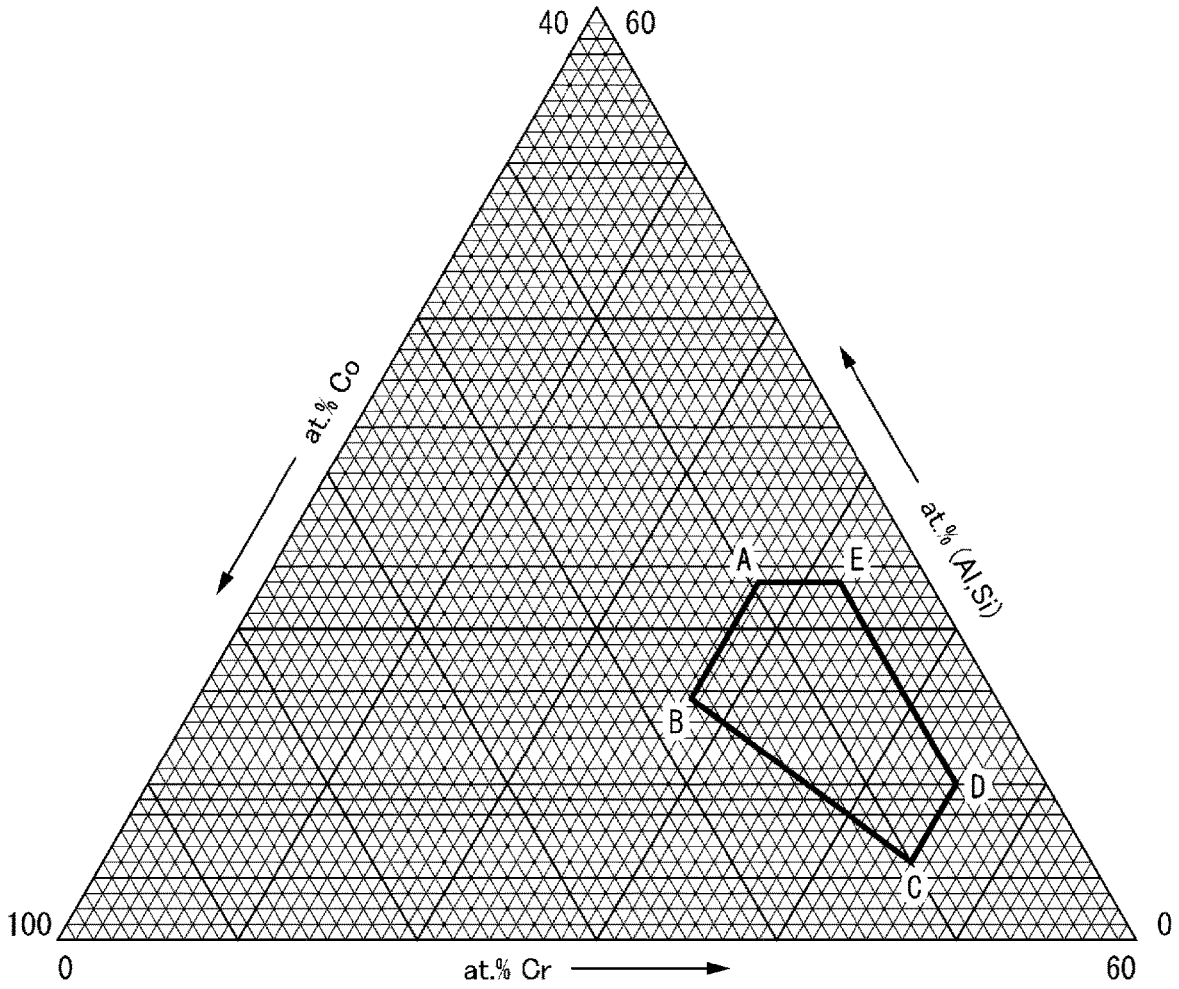
[FIG. 2]
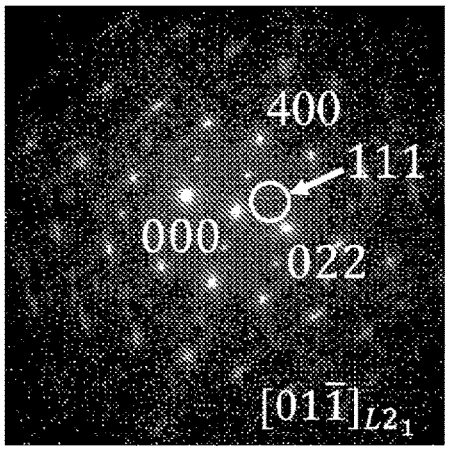

[FIG. 3]
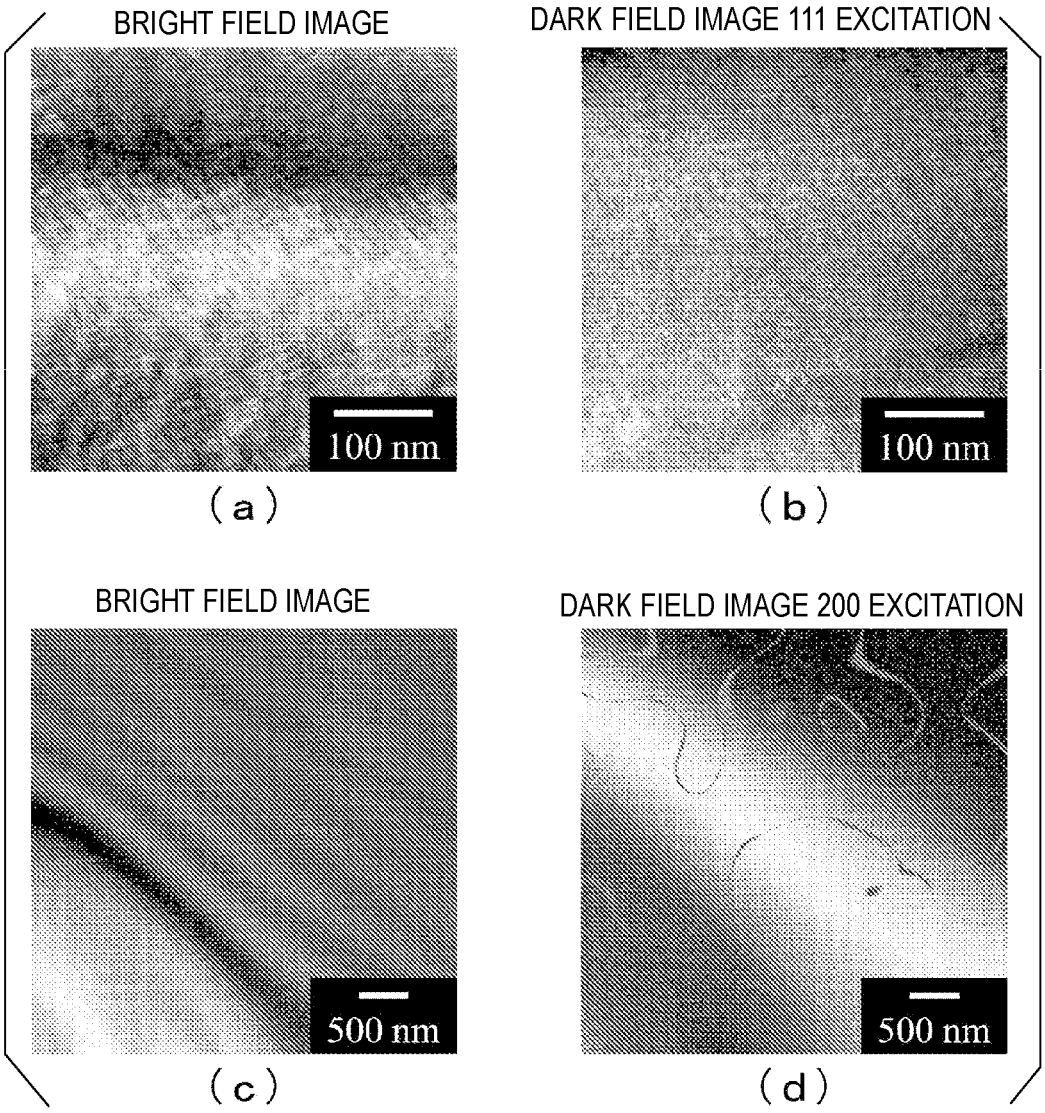
[FIG. 4A]
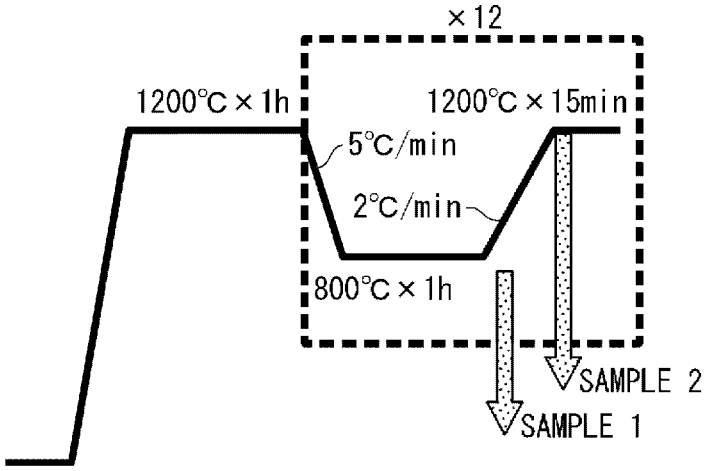

[FIG. 4B]
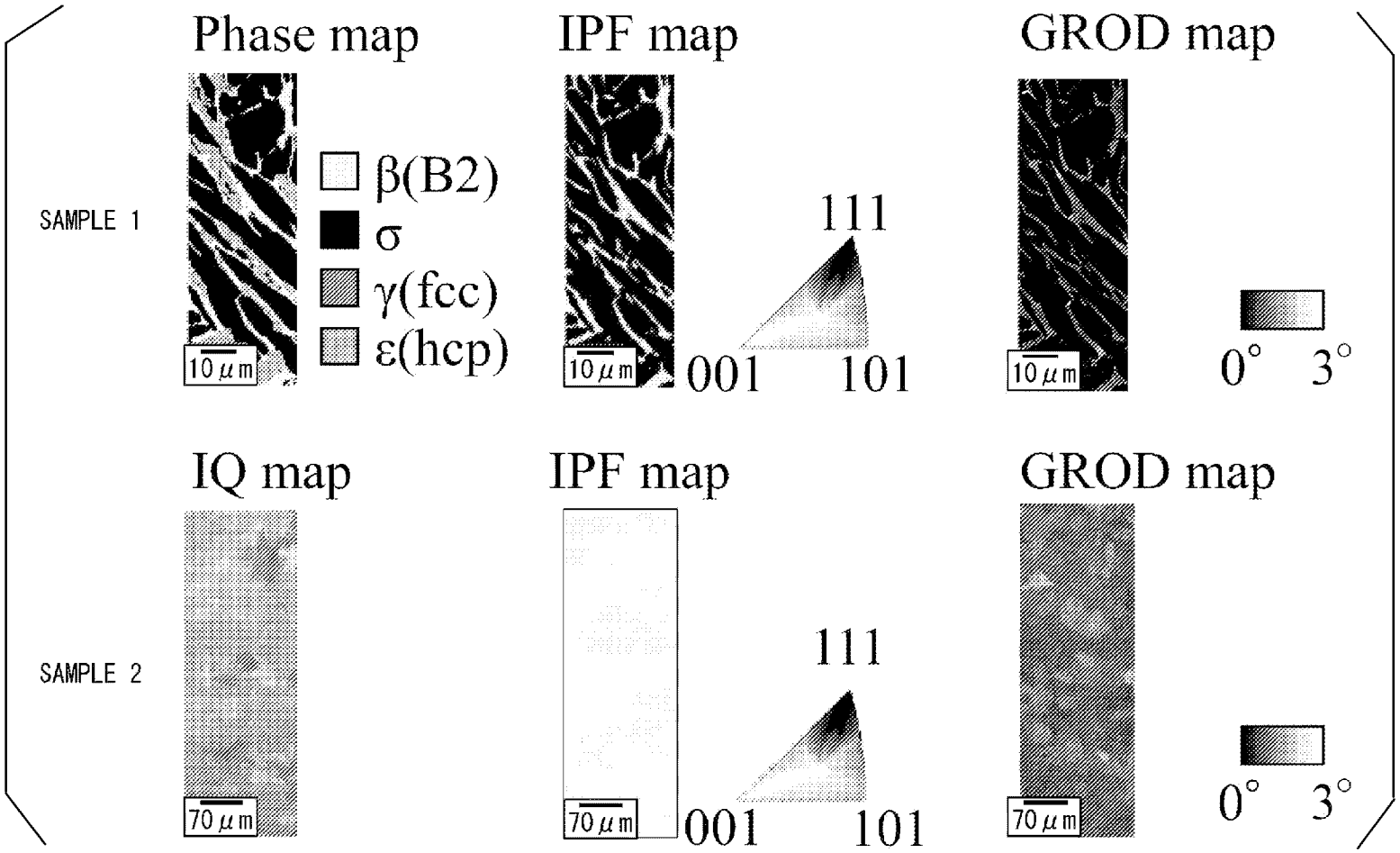

[FIG. 5A]
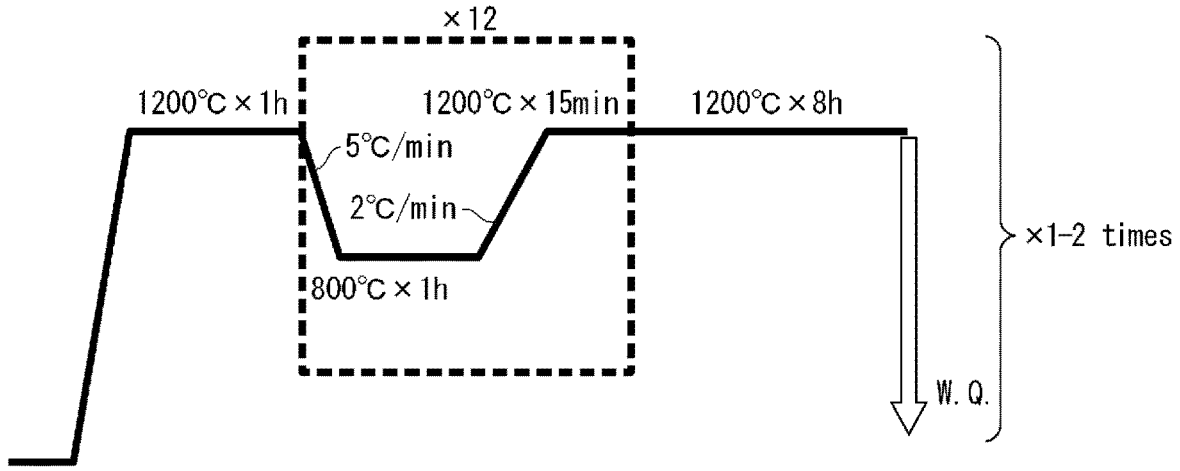
[FIG. 5B]
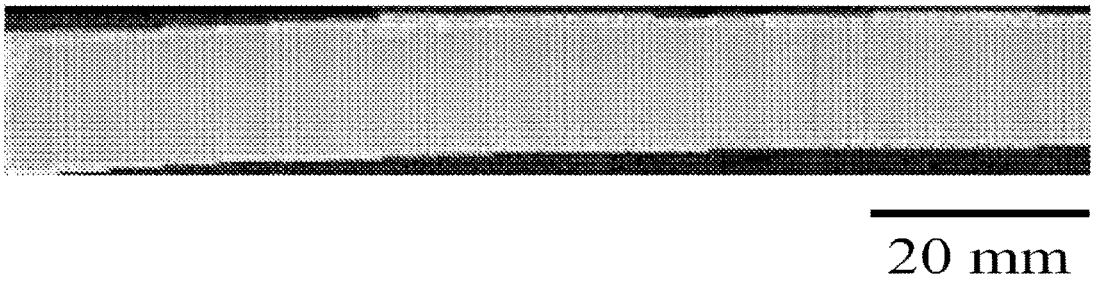

[FIG. 6]
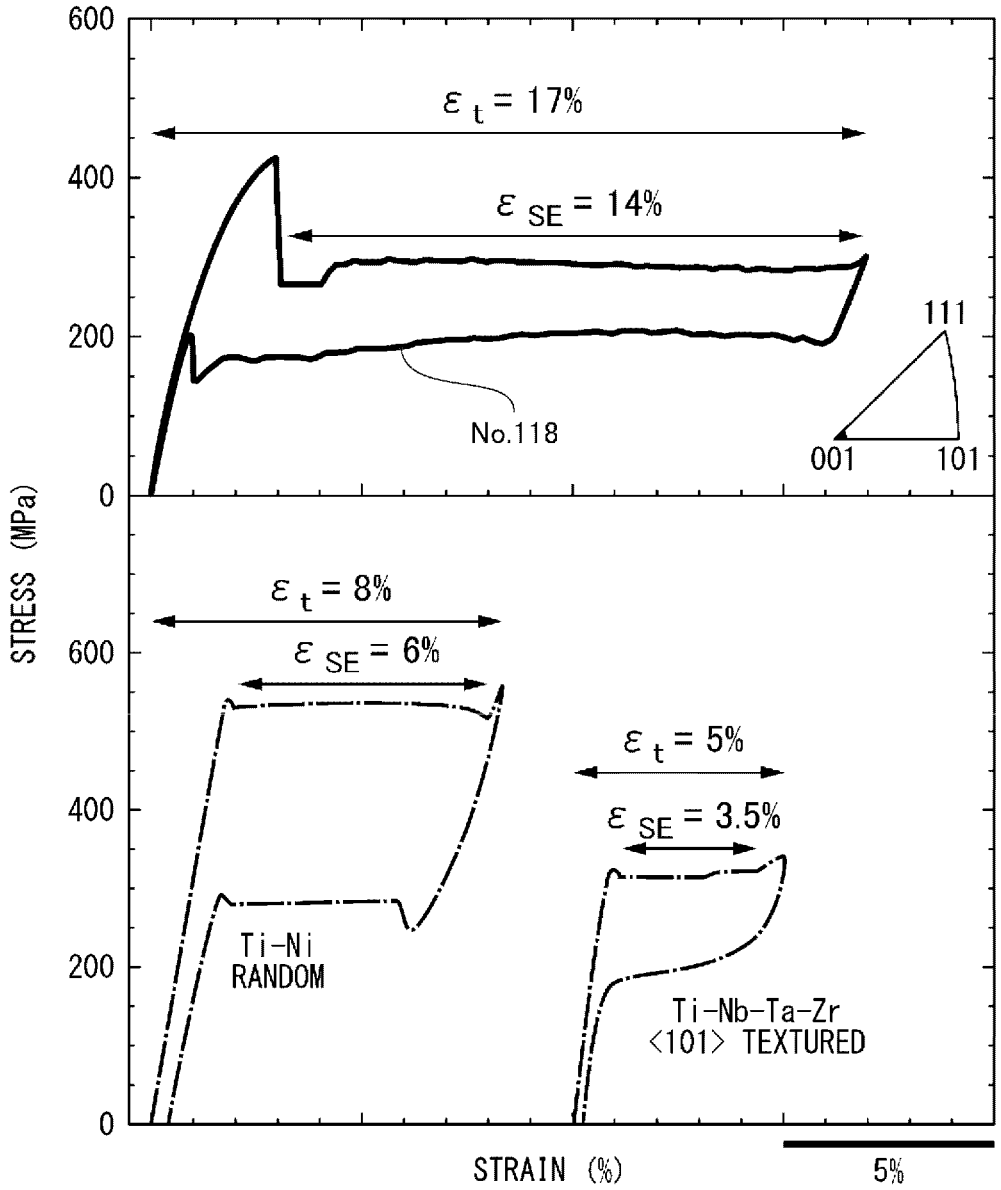

[FIG. 7A]
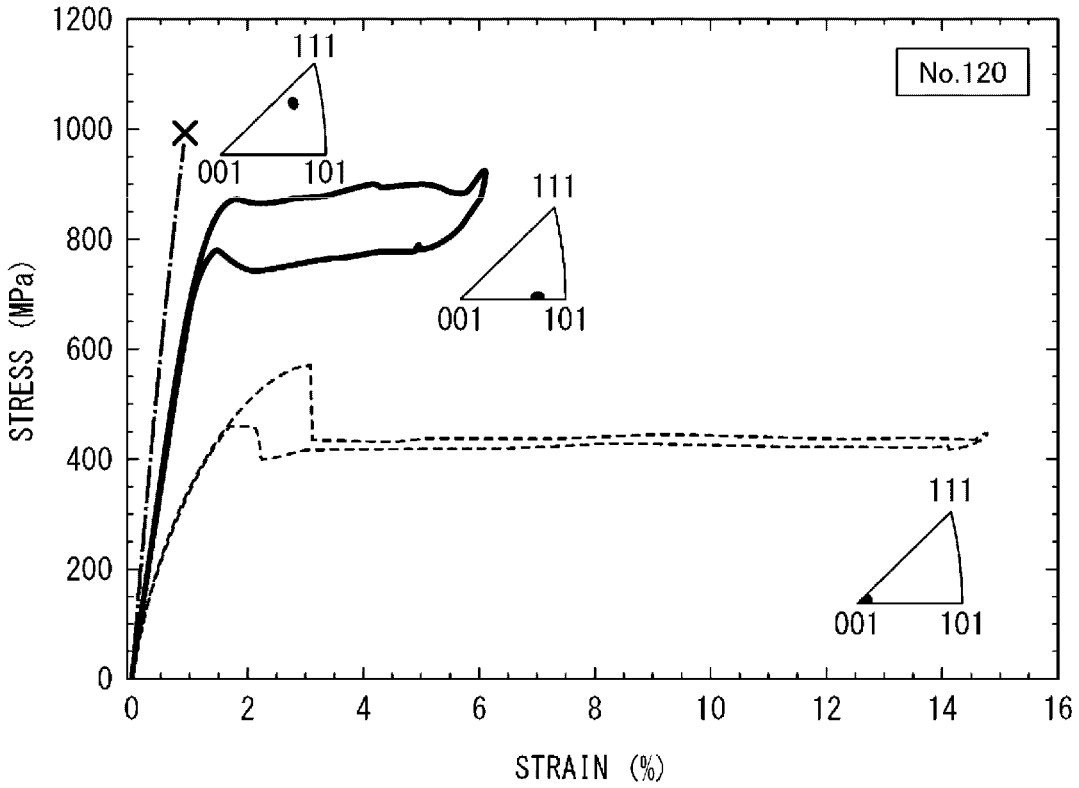
[FIG. 7B]
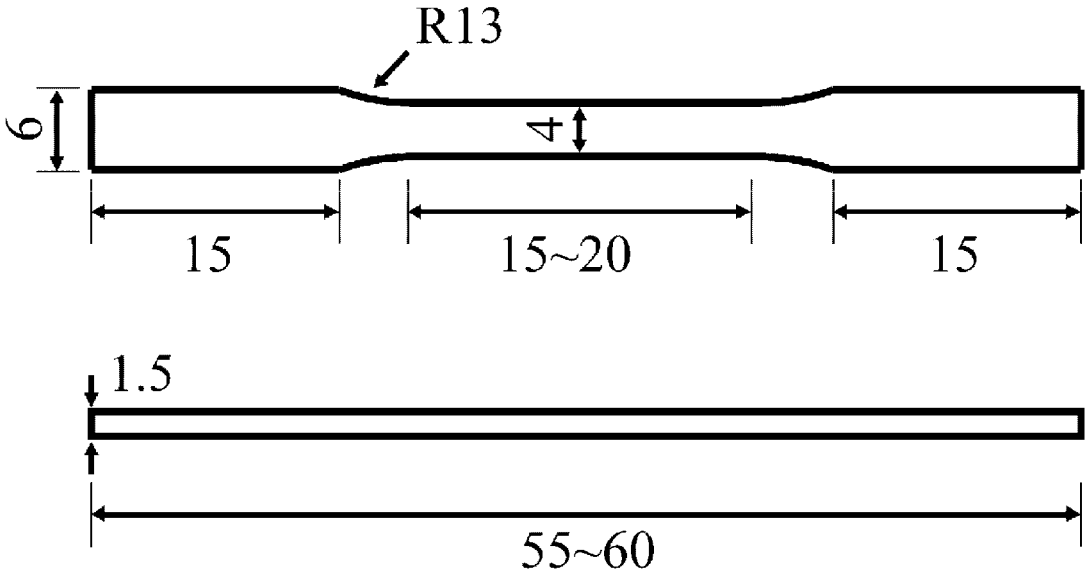

[FIG. 8A]
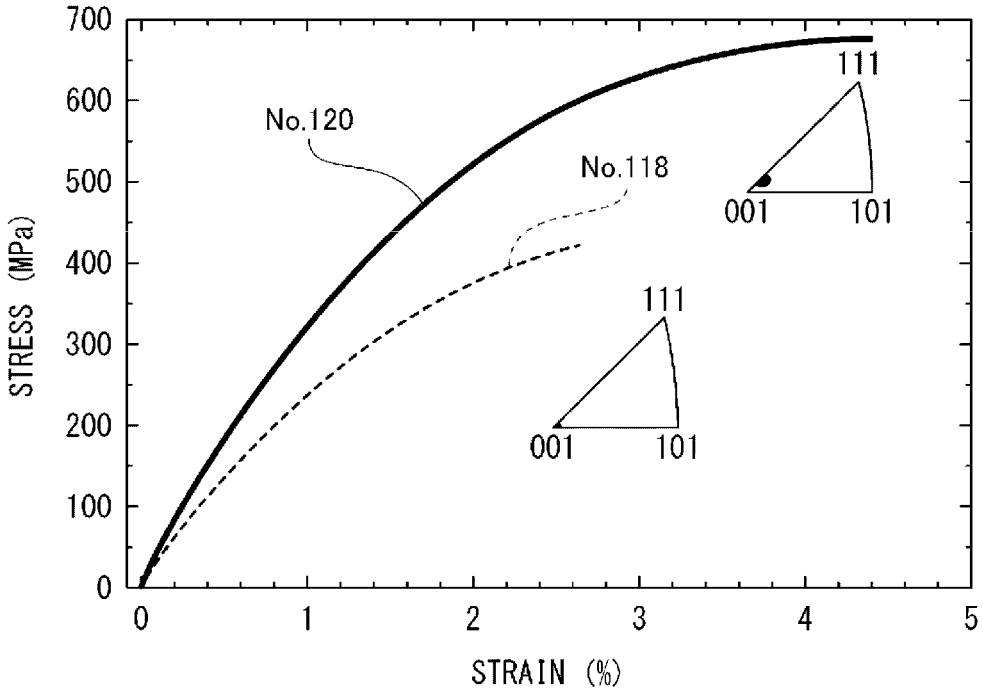
[FIG. 8B]
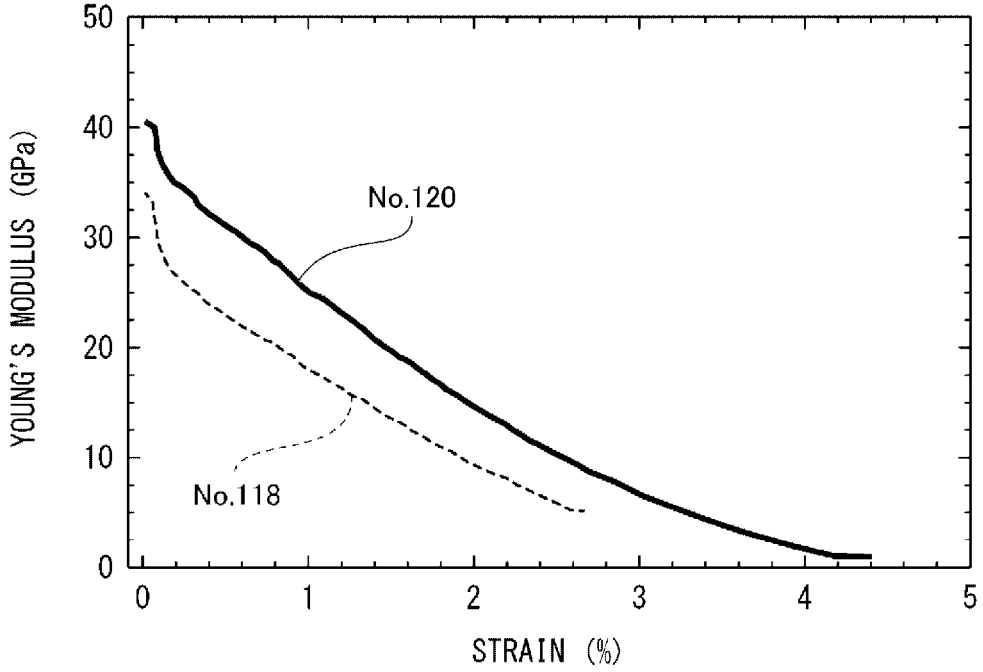

[FIG. 9]
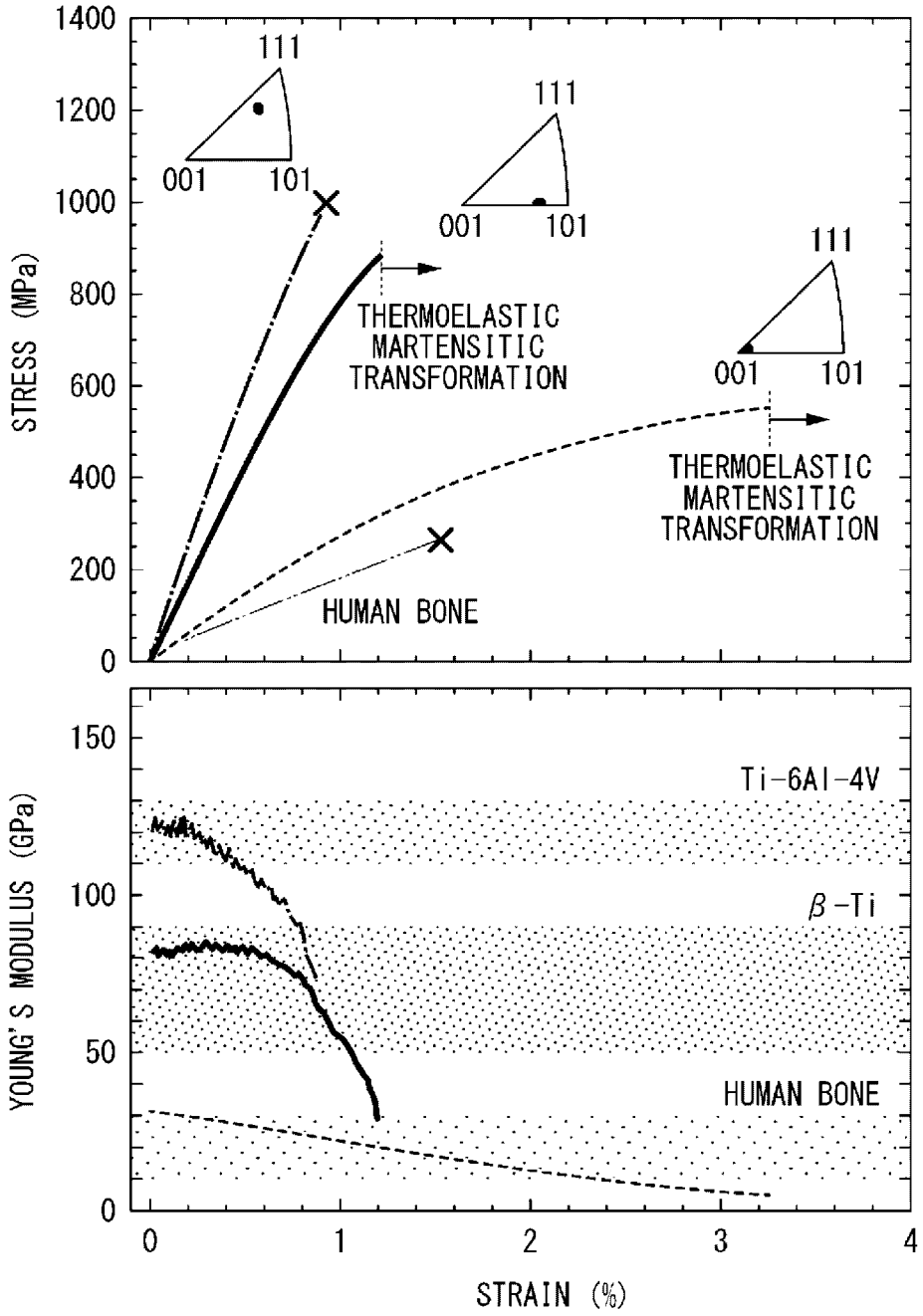

[FIG. 10]
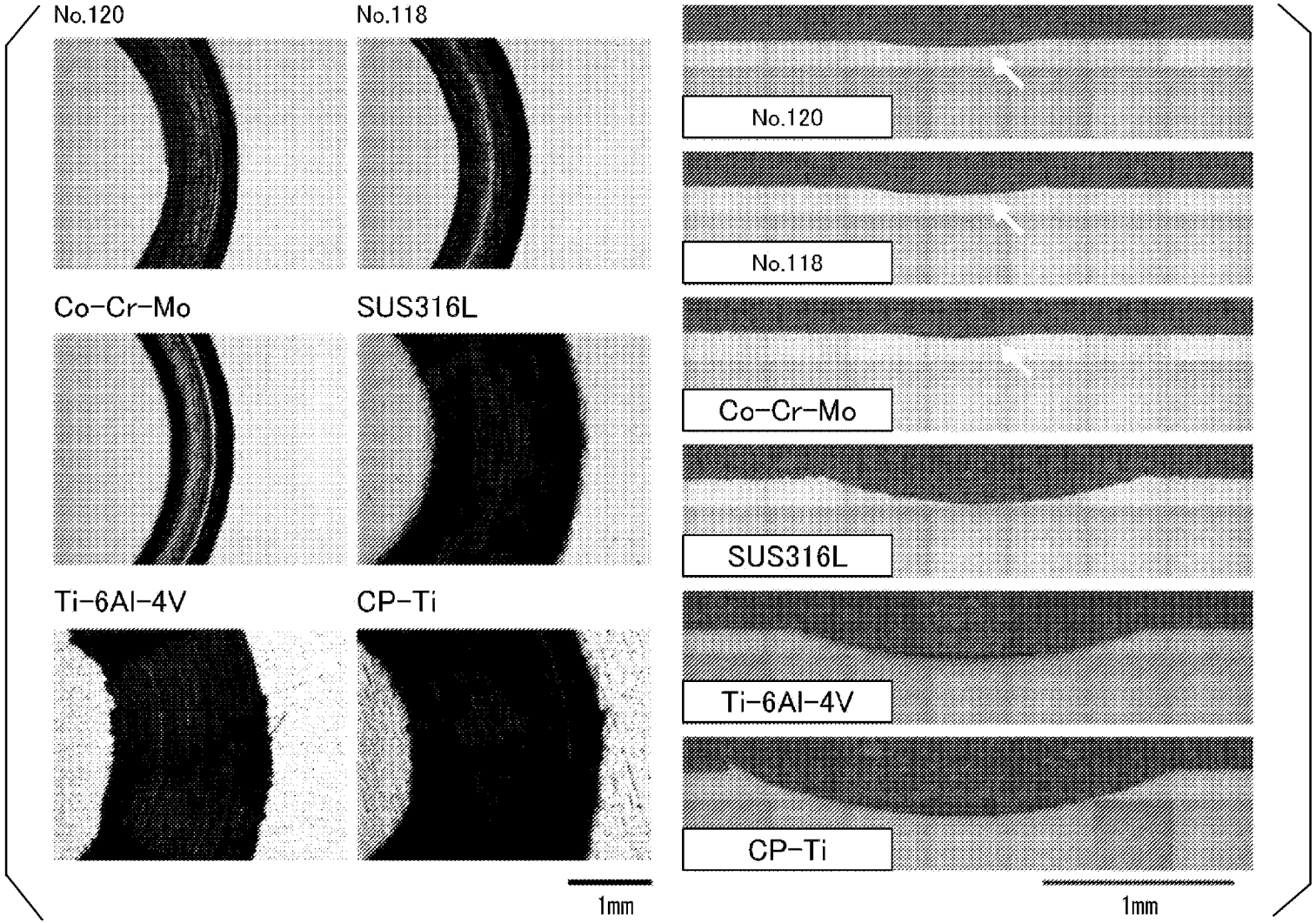

Co-BASED SUPERELASTIC ALLOY MATERIALS, PLATE MATERIALS AND WIRE MATERIALS COMPRISING Co-BASED SUPERELASTIC ALLOY MATERIALS, Co-BASED SUPERELASTIC ALLOY MATERIALS MANUFACTURING METHODS, STENTS, GUIDE WIRES, AND HIP IMPLANTS

CROSS REFERENCE TO RELATED APPLICATIONS

This application is the U.S. National Stage entry of International Application No. PCT/JP2022/011653, filed on Mar. 15, 2022, which, in turn, claims priority to Japanese Patent Application No. 2021-104095, filed on Jun. 23, 2021, the disclosures both of which are hereby incorporated herein by reference in their entireties for all purposes.

TECHNICAL FIELD

The present invention relates to Co-based superelastic alloy materials, plate materials and wire materials containing Co-based superelastic alloy materials, Co-based superelastic alloy materials manufacturing methods, stents, guide wires, and hip implants, and more particularly to Co-based superelastic alloy materials suitable as biomaterials, plate materials and wire materials containing Co-based superelastic alloy materials, and Co-based superelastic alloy materials manufacturing methods.

This application claims priority based on a Japanese patent application No. 2021-104095 filed on Jun. 23, 2021, and the contents thereof are incorporated herein by reference.

BACKGROUND ART

Stainless steels, Co—Cr alloys, and Ti alloys are widely used as biomaterials. Among the biomaterials, for example, a bone substitute implant material is desirable to have a Young's modulus as low as that of a bone in order to prevent stress shielding. Here, the stress shielding is a phenomenon in which, when an implant material having a Young's modulus higher than that of a living bone is used, a stress is preferentially applied to the implant material, and a stress applied to surrounding bones is shielded. When stress shielding occurs, a bone may atrophy, resulting in problems of bone loss and the like.

In recent years, β—Ti alloys have attracted attention as materials that can achieve a low Young's modulus of about 50 GPa. The β-Ti alloys have a low Young's modulus but is lack of wear resistance, and there is a concern that the β—Ti alloys may be damaged by wear when applied as biomaterials.

Meanwhile, Co—Cr alloys are known as materials having excellent wear resistance. However, since the Co—Cr alloys have a very high Young's modulus of about 10 times that of a living bone, problems of stress shielding may occur when the Co—Cr alloys are applied as biomaterials.

Thus, the low Young's modulus and the wear resistance are competing properties, and it is fairly difficult to develop a biomaterial that can achieve both the properties.

In various fields such as industry and medicine, practical use of shape memory alloys is promoted in order to utilize unique functions thereof. Among them, Ti—Ni-based alloys, Ni—Al-based alloys, Cu—Zn—Al-based alloys, Cu—Al—Ni-based alloys, and the like are known as shape memory alloys having an excellent superelastic property, and in particular, the Ti—Ni alloy is an example as a practical material for a biomaterial.

Further, PTL 1 discloses Cu—Al—Mn-based alloys having a recrystallized microstructure formed of a β single phase as alloys having an excellent superelastic property.

CITATION LIST

Patent Literature

PTL 1: JP6490608B

Non Patent Literature

NPL 1: K. Hirata, X. Xu, T. Omori, M. Nagasako, and R. Kainuma, Journal of Alloys and Compounds 642 (2015) 200-203.

NPL 2: T. Odaira, X. Xu, A. Miyake, T. Omori, M. Tokunaga, and R. Kainuma, Scripta Materialia 153 (2018) 35-39.

NPL 3: T. Odaira, X. Xu, T. Omori, and R. Kainuma. The 6th International Conference on Ferromagnetic Shape Memory Alloys, 2019, 164, ISBN 978-80-905962-9-0.

NPL 4: K. Hirata, X. Xu, T. Omori, and R. Kainuma, Journal of Magnetism and Magnetic Materials 500 (2020) 166311.

NPL 5: T. Odaira, X. Sheng, X. Xu, T. Omori, and R. Kainuma, Applied Physics Reviews 7 (2020) 031406.

SUMMARY OF INVENTION

Technical Problem

As described above, since the low Young's modulus and the wear resistance are competing properties, no biomaterial achieves both the properties.

Although the Ti—Ni alloy has been put into practical use as a biomaterial having an excellent superelastic property, use thereof is limited due to poor workability. In addition, since Ni allergy is regarded as a problem, it is desirable to develop Ni-free superelastic materials. In this respect, the β—Ti alloys having a low Young's modulus are Ni-free but has a very low superelastic strain of about 3%.

The Cu—Al—Mn-based alloys disclosed in PTL 1 have an excellent superelastic property but are not suitable as biomaterials. Therefore, it is strongly desirable to develop biomaterials having excellent superelastic property.

It is difficult to coarsen crystal grains in Co—Cr—Al—Si alloys disclosed in NPLs 1 to 5, and a large single crystal exceeding 1 cm, for example, cannot be prepared. Further, the Co—Cr—Al—Si alloy disclosed in NPL 5 is brittle and has a poor workability, such as a rolling reduction ratio less than 20%.

In view of the above, the object of the present invention is to provide Co-based superelastic alloy materials that have excellent workability, excellent superelastic property, and excellent wear resistance and those can exhibit different Young's moduli depending on crystal orientations. Another object of the present invention is to provide plate materials and wire materials containing such Co-based superelastic alloy materials, Co-based superelastic alloy materials manufacturing methods, stents, guide wires, and hip implants.

Solution to Problem

The present inventors first focused on compositions of Co-based alloys and conducted composition design from the viewpoint of superelastic property, wear resistance, and Young's modulus. As a result, it was found that Co-based superelastic alloy materials that have excellent workability, excellent superelastic property, and excellent wear resistance and those can exhibit different Young's moduli depending on crystal orientations could be obtained by controlling the content of each component within appropriate ranges in alloys containing Co, Cr, Al, and Si (hereinafter, also referred to as Co—Cr—Al—Si alloys), and thus the present invention was completed.

The present invention has been made based on the above findings, and a gist thereof is as follows.

(1) A Co-based superelastic alloy material according to an embodiment of the present invention is a Co-based superelastic alloy material containing: a Co—Cr—Al—Si-based alloy, in which the Co-based superelastic alloy material has a composition (at. %) within a pentagon area on the Co—Cr—(Al,Si) pseudo-ternary phase diagram, and containing Al: 2.5 at. % to 10.0 at. % and Si: 2.5 at. % to 13.0 at. %, the pentagon area being formed of five points of point A: $Co_{43.5}Cr_{27.5}(Al,Si)_{23}$, point B: $Co_{57}Cr_{27.5}(Al,Si)_{15.5}$, point C: $Co_{50}Cr_{45}(Al,Si)_{5}$, point D: $Co_{45}Cr_{45}(Al,Si)_{10}$, and point E: $Co_{45}Cr_{32}(Al,Si)_{23}$.

[2] the Co-based superelastic alloy material according to the above [1], the main phase of the metallographic structure may be a β phase having a BCC structure.

[3] In the Co-based superelastic alloy material according to the above [1] or [2], the volume ratio of the β phase having a BCC structure may be 50% or more.

[4] In the Co-based superelastic alloy material according to the above [2] or [3], in addition to the main phase, one or two or more selected from the group consisting of a γ phase having an FCC structure, an e phase having an HCP structure, and a σ phase may be contained in an amount of 50 vol % or less in total.

[5] In the Co-based superelastic alloy material according to the above [2] to [4], the crystal structure of the β phase may be formed of one or two or more selected from the group consisting of an A2 phase, a B2 phase, and an $L2_1$ phase.

[6] In the Co-based superelastic alloy material according to the above [2] to [5], the proportion of the B2 phase in the β phase may be 20 volt or more.

(7) A plate material according to an embodiment of the present invention is a plate material containing: the Co-based superelastic alloy material according to any one of the above [1] to [6], in which the Co-based superelastic alloy material has an average crystal grain size equal to or larger than a thickness of the plate material.

[8] A wire material according to an embodiment of the present invention is a wire material containing: the Co-based superelastic alloy material according to any one of the above [1] to [6], in which the Co-based superelastic alloy material has an average crystal grain size equal to or larger than a radius of the wire material.

[9] A Co-based superelastic alloy material manufacturing method according to an embodiment of the present invention is a method for manufacturing the Co-based superelastic alloy material according to any one of the above [1] to [6], including: a solution heat treatment step of performing a heat treatment at 1100° C. to 1400° C.

[10] The Co-based superelastic alloy material manufacturing method according to the above [9] may further include: a cooling step of performing cooling to room temperature at an average cooling rate of 5° C./s or more after the solution heat treatment step.

[11] The Co-based superelastic alloy material manufacturing method according to the above [9] or may further include: a crystal 1 grain coarsening step of repeatedly performing a heat treatment in a temperature range where a β single phase is formed, and a temperature range where two phases of β phase+γ phase or β phase+σ phase are formed or a temperature range where three phases of β phase+γ phase+σ phase are formed after the solution heat treatment step.

[12] In the Co-based superelastic alloy material manufacturing method according to the above [11], the temperature range where the β single phase is formed may be 1100° C. to 1400° C., and the temperature range where the two phases are formed or the temperature range where the three phases are formed may be 700° C. to 1100° C.

[13] A guide wire according to an embodiment of the present invention contains a material containing the Co-based superelastic alloy material according to any one of the above [1] to [6].

[14] A stent according to an embodiment of the present invention contains a material containing the Co-based superelastic alloy material according to any one of the above [1] to [6].

[15] A hip implant according to an embodiment of the present invention contains a material containing the Co-based superelastic alloy material according to any one of the above [1] to [6].

Advantageous Effects of Invention

According to the present invention, it is possible to provide a Co-based superelastic alloy material that has excellent workability, an excellent superelastic property, and excellent wear resistance and that can exhibit different Young's moduli by controlling the crystal orientation, a plate material and a wire material containing the Co-based superelastic alloy material, and a Co-based superelastic alloy material manufacturing method. The Co-based superelastic alloy material according to the present invention can exhibit a more excellent superelastic property than those in the related art, has excellent wear resistance, and can exhibit different Young's moduli by controlling crystal orientations. Therefore, the Co-based superelastic alloy materials can be suitably used as various biomaterials in a wide variety of fields.

BRIEF DESCRIPTION OF DRAWINGS

FIG. 1 is the Co—Cr—(Al,Si) pseudo-ternary phase diagram.

FIG. 2 is a diffraction pattern (selected area diffraction pattern) obtained when an electron beam is incident in the [01-1] direction of the main phase (β phase) of the alloy No. 120.

FIG. 3 (*a*) to (*d*) in FIG. 3 are electron microscope images of the alloy No. 120.

FIG. 4A is a graph showing the temperature profile of the crystal grain coarsening step (cyclic heat treatment) using the alloy No. 120.

FIG. 4B shows analysis results by EBSD of Sample 1 and Sample 2 shown in FIG. 4A.

FIG. 5A is a graph showing the temperature profile in the crystal grain coarsening step (cyclic heat treatment) and the subsequent solution heat treatment step using the alloy No. 120.

FIG. 5B is an EBSD observation result of a cross-section parallel to the plate surface in a plate material prepared using the alloy No. 120.

FIG. 6 is a stress-strain curve of a single crystal sample obtained from the alloy No. 118.

FIG. 7A shows the stress-strain curves of the single crystal samples obtained from the alloy No. 120.

FIG. 7B are schematic illustrations showing the tensile-test specimens used for measuring the stress-strain curves (S-S curve) in Examples.

FIG. 8A shows the stress-strain curves of the single crystal samples obtained from the alloys No. 118 and No. 120.

FIG. 8B shows the relationship figure between the Young's modulus and the strain obtained from the stress-strain curves in FIG. 8A.

FIG. 9 shows the stress-strain curves of the single crystal samples obtained from the alloy No. 120 and the relationship between the Young's modulus and the strain obtained from the stress-strain curves.

FIG. 10 shows photographs of wear tracks after wear tests and photographs of cross-sections of the wear traces.

DESCRIPTION OF EMBODIMENTS

Hereinafter, Co-based superelastic alloy materials, plate materials and wire materials containing Co-based superelastic alloy materials, and Co-based superelastic alloy materials manufacturing methods according to the present embodiment will be described. However, the present invention is not limited to the configuration disclosed in the present embodiment, and various modifications can be made without departing from the gist of the present invention.

[Co-Based Superelastic Alloy Material]

First, the Co-based superelastic alloy materials according to the present embodiment will be described in detail below. In the present description, unless otherwise specified, the content of each element is based on the entire alloy material (100 at. %).

Composition

The Co-based superelastic alloy materials according to the present embodiment contain Co, Cr, Al, Si, and unavoidable impurities. That is, a Co-based superelastic alloy material according to the present embodiment contains a Co—Cr—Al—Si-based alloy.

The compositions (at. %) of the Co-based superelastic alloy materials according to the present embodiment are compositions surrounded by a pentagon formed of five points of point A: $Co_{49.5}Cr_{27.5}(Al,Si)_{23}$, point B: $Co_{57}Cr_{27.5}(Al,Si)_{15.5}$, point C: $Co_{50}Cr_{45}(Al,Si)_{5}$, point D: $Co_{45}Cr_{45}(Al,Si)_{10}$, and point E: $Co_{45}Cr_{32}(Al,Si)_{23}$ on the Co—Cr—(Al,Si) ("(Al,Si)" is the sum of the compositions of Al and Si) pseudo-ternary phase diagram shown in FIG. 1, and are compositions containing Al within the range of 2.5 at. % to 10.0 at. % and Si within the range of 2.5 at. % to 13.0 at. %. The expression "compositions surrounded by a pentagon" means the compositions on each side of and inside the pentagon.

Here, in the case of a general ternary phase diagram, assuming an "A-B-C ternary system", vertices of the triangle correspond to 100% A, 100% B, and 100% C, respectively. However, in the present embodiment, in order to define the compositions of the Co—Cr—Al—Si-based alloys, a pseudo-ternary phase diagram in which three sides are defined to correspond to Co, Cr, and the sum of Al and Si, respectively, is used. Vertices of the pseudo-ternary phase diagram shown in FIG. 1 mean "40% Co-0% Cr-60% (Al,Si)", "100% Co-0% Cr-0% (Al,Si)", and "40% Co-60% Cr-0% (Al,Si)" in terms of at. %, respectively. The vertices may also be referred to as "$Co_{40}(Al,Si)_{60}$", "$Co_{100}$", and "$Co_{40}Cr_{60}$".

The Co-based superelastic alloy materials according to the present embodiment substantially do not contain components other than Cr, Al, Si, and Co. Here, the expression "substantially do not contain" means that unavoidable impurities are contained to such an extent that effects and properties of the present invention are not impaired. The unavoidable impurities are components that are mixed due to various factors in the manufacturing processes such as raw materials when manufacturing the alloy materials industrially, and include components that are unavoidably mixed. The content of the unavoidable impurities is desired to be as low as possible and is preferably less than 1.0 mass % with respect to the total mass of the alloy materials.

By adjusting the compositions within the pentagon of the points A to E, it is possible to provide Co-based superelastic alloy materials that have excellent workability, excellent superelastic property, and excellent wear resistance and that can exhibit different Young's moduli depending on crystal orientations. When a composition is out of the side EA and the side AB, the workability decreases, and further, it is difficult to form a coarse grain or a single crystal. When a composition is out of the side BC, the superelastic property and the Young's modulus property decrease. When a composition is out of the side CD and the side DE, the superelastic property, the Young's modulus, and the workability all decrease.

Al is an element having an effect of influencing phase stability of the β phase and the workability. In particular, in order to improve the hot workability, it is necessary to control the Al content. That is, the hot workability can be improved by adjusting the Al content.

When the Al content is less than 2.5 at. %, the β phase may not be sufficiently obtained. Therefore, the Al content is 2.5 at. % or more, preferably 4.5 at. % or more, and more preferably 5.0 at. % or more. On the other hand, when the Al content is more than 10.0 at. %, the hot workability may decrease. Therefore, the Al content is 10.0 at. % or less, preferably 9.0 at. % or less, and more preferably 8.0 at. % or less.

Similar to Al, Si is an element having an effect of influencing the phase stability of the β phase and the workability. In particular, in order to improve the hot workability, it is necessary to control the Si content. That is, the hot workability can be improved by adjusting the Si content.

When the Si content is less than 2.5 at. %, the β phase may not be sufficiently obtained. Therefore, the Si content is 2.5 at. % or more, preferably 6.5 at. % or more, and more preferably 7.0 at. % or more. On the other hand, when the Si content is more than 13.0 at. %, the hot workability may decrease. Therefore, the Si content is 13.0 at. % or less, preferably 12.0 at. % or less, and more preferably 11.0 at. % or less.

The elements described above are basic components contained in the Co-based superelastic alloy materials according to the present embodiment. That is, the Co-based superelastic alloy materials according to the present embodiment substantially do not contain components other than Cr, Al, Si, and Co. Unavoidable impurities may be mixed due to various factors in the manufacturing process, such as raw-material-derived components. The content of such unavoidable impurities is preferably as low as possible as described above, and, for example, is preferably less than 1.0 mass % with respect to the total mass of the alloy material.

<Metallographic Structure>

It is desirable that the metallographic structure of the Co-based superelastic alloy materials according to the present embodiment is a microstructure having the β phase having the BCC structure, as the main phase. The term "main phase" as used herein means a phase that is 50 volt or more of the total metallographic structure of the Co-based superelastic alloy material. When a volume ratio of the β phase is less than 50%, the superelastic property may not be sufficiently obtained. Further, it may be difficult to precisely control the Young's modulus for each crystal orientation. Therefore, it is more desirable that the volume ratio of the β phase is 50% or more. It is considered that the hot workability to be described later is improved since the degree of order of the β phase as the main phase is reduced in the Co-based superelastic alloy materials according to the present embodiment.

The Co-based superelastic alloy material may also be a single crystal having no crystal grain boundary between B phases.

The crystal structure of the β phase as the main phase is preferably a crystal structure formed by one or two or more selected from the group consisting of an A2 type (A2 phase), a B2 type (B2 phase), and an $L2_1$ type ($L2_1$ phase) from the viewpoint of sufficiently exhibiting the superelastic property and the workability. In order to further exhibit the effect, the crystal structure of the main phase more preferably contains a large amount of the B2 type. In order to sufficiently ensure the superelastic property, it is preferable that the crystal structure of the β phase basically contains a fine phase formed of one or both of the B2 type and the $L2_1$ type. The fine phase in this case is, for example, less than 10 nm. Although the crystal structure of the β phase may contain the A2 type, the superelastic property decreases as a volume fraction of the A2 type increases. Meanwhile, in order to sufficiently ensure the workability, it is preferable that the crystal structure of the β phase basically contains a fine phase formed of one or both of the A2 type and the B2 type. The fine phase in this case is, for example, less than 10 nm. Although the crystal structure of the β phase may contain the $L2_1$ type, the workability decreases as a volume fraction thereof increases. Therefore, the crystal structure of the β phase may contain a small amount of the A2 type and the $L2_1$ type and more preferably contains a large amount of the B2 type.

As described above, in order to sufficiently obtain both a favorable superelastic property and favorable workability, the proportion of the B2 type in the β phase is preferably 20 vol % or more. The proportion of the B2 type in the β phase is more preferably 30 vol % or more and still more preferably 40 vol % or more.

In addition to the main phase, one or two or more of the γ phase having an FCC structure, the ε phase having an HCP structure, and the σ phase may be precipitated in a small amount.

The γ phase contributes to an effect of improving the hot workability and easily obtaining coarse grains, but may impair the superelastic property when contained in a large amount.

The ε phase contributes to an effect of improving the wear resistance and easily obtaining coarse grains, but may impair the superelastic property when contained in a large amount.

The σ phase contributes to the effect of improving the wear resistance and easily obtaining coarse grains, but may impair both the superelastic property and the hot workability when contained in a large amount.

Therefore, when one or two or more of the γ phase, the ε phase, and the σ phase are precipitated in addition to the main phase in the metallographic structure of the Co-based superelastic alloy materials, a total amount thereof is preferably 50 volt or less.

[Co-Based Superelastic Alloy Material Manufacturing Method]

The Co-based superelastic alloy materials can be manufactured by a usual method by performing a solution treatment in a specific temperature range to be described later after melting and casting, and hot working (hot forging, hot rolling, or the like). Manufacturing conditions in each step are not particularly limited. For example, the temperature in the hot working may be 1100° C. to 1400° C., and the hot working ratio may be 10% or more.

For the manufacturing methods of the Co-based superelastic alloy materials according to the present embodiment, the solution treatment is performed after the hot working. The solution treatment is performed by heating a Co-based superelastic alloy material, which is melted and cast, and formed by hot working or the like, to a solid solution temperature to form a microstructure into a B single phase having a BCC structure, and then performing rapid cooling. The solution treatment is performed with a solid solution temperature in a temperature range of 1100° C. to 1400° C. Since the β single phase is obtained more easily as the temperature in the solution treatment increases, the solution treatment is preferably performed at 1100° C. to 1400° C., which is close to the melting point.

The holding time at the solid solution temperature is not particularly limited and is preferably 60 minutes or longer from the viewpoint of sufficiently increasing the temperature. However, when the holding time exceeds 24 hours, oxidation may occur, and thus the holding time is preferably 24 hours or shorter.

Here, in the case of coarsening the crystal grains of a Co-based superelastic alloy material to form coarse grains or a single crystal, it is preferable to perform a crystal grain coarsening step (cyclic heat treatment) to be described later after the solution heat treatment step described above. That is, after the solution heat treatment step, the Co-based superelastic alloy material can be formed into coarse grains or a single crystal by repeating a heat treatment in a temperature range where the β single phase is formed, and a temperature range where two phases of β phase+γ phase or β phase+σ phase are formed or a temperature range where three phases of β phase+γ phase+σ phase are formed. The number of times of the crystal grain coarsening step is not limited to a plurality of times, and for example, an effect can be obtained by performing only once. That is, the crystal grain coarsening step may be a step of cooling the Co-based superelastic alloy material, after the solution heat treatment, to a temperature range where the two phases of β phase+γ phase or β phase+σ phase are formed or a temperature range where the three phases of β phase+γ phase+σ phase are formed with an average cooling rate at a level to be described later, holding for a certain time, then heating to a temperature range where the β single phase is formed, and further holding. Accordingly, the Co-based superelastic alloy material can be formed into coarse grains or a single crystal. However, in order to further coarsen the crystal grains or manufacture a larger single crystal, it is preferable to perform the crystal grain coarsening step a plurality of times after the solution heat treatment step.

Hereinafter, the case where the crystal grain coarsening step is performed a plurality of times will be described in detail.

In the crystal grain coarsening step (cyclic heat treatment), first, a Co-based superelastic alloy material is cooled from the solid solution temperature described above to the temperature range where two phases are formed or the temperature range where three phases are formed. Specifically, the Co-based superelastic alloy material is cooled to a temperature range of 700° C. to 1100° C., which is the temperature range where two phases are formed or the temperature range where the three phases are formed. The average cooling rate at this time is preferably 0.1° C./min or more, and more preferably 1° C./min or more from the viewpoint of improving efficiency. The upper limit of the average cooling rate is not particularly limited and may be 20° C./min or less. The cooling is performed by charging the Co-based superelastic alloy material into a refrigerant such as water or by forced air cooling.

Subsequently, the Co-based superelastic alloy material is held in the temperature range where two phases are formed or the temperature range where three phases are formed. The holding time is preferably 1 minute to 24 hours. When the holding time is excessively long, oxidation may occur, and thus the holding time is preferably 24 hours or shorter. On the other hand, when the holding time is excessively short, the precipitate of the γ phase, the σ phase, or the γ phase and the σ phase cannot be sufficiently generated, and thus the holding time in the temperature range where two phases are formed or the temperature range where three phases are formed is preferably 1 minute or longer.

After being held in the temperature range where two phases are formed or the temperature range where three phases are formed, the temperature is increased to the temperature range where the β single phase is formed and further held. Specifically, the temperature is increased to a temperature range of 1100° C. to 1400° C., which is the temperature range where the β single phase is formed. The average temperature increase rate at this time is not particularly limited and is preferably 20° C./min or less, more preferably 10° C./min or less from the viewpoint of easily obtaining coarse grains or a single crystal. When the average temperature increase rate is excessively low, the efficiency may decrease, and thus the average temperature increase rate is preferably 0.1° C./min or more.

The "average cooling rate" in the present embodiment is a value obtained by dividing the temperature drop of the alloy material from the start of cooling to the end of cooling by the time required from the start of cooling to the end of cooling. The "average temperature increase rate" is a value obtained by dividing the temperature rise of the alloy material from the start of heating to the end of heating by the time required from the start of heating to the end of heating.

In order to form the Co-based superelastic alloy materials into coarse grains or single crystals, as described above, it is preferable to repeatedly perform the heat treatment in the temperature range where the β single phase is formed, and the temperature range where the two phases of β phase+γ phase or β phase+σ phase are formed or the temperature range where the three phases of β phase+γ phase+σ phase are formed, and the number of repetition is about 1 to 20 cycles. That is, when the heat treatment of "cooling from the temperature range where the β single phase is formed to the temperature range where the two phases are formed or the temperature range where the three phases are formed, holding, heating to the temperature range where the β single phase is formed again, and holding" is defined as one cycle, it is possible to easily form the Co-based superelastic alloy materials into coarse grains or single crystals by repeating 1 to 20 cycles. As a result, an effect of producing coarse grains or single crystals can be obtained.

After the solution heat treatment step or the crystal grain coarsening step (cyclic heat treatment) after the solution heat treatment step, the Co-based superelastic alloy material is held in the temperature range where the B single phase is formed, and then cooled (cooling step) to room temperature (about 25° C.). At the time of cooling at this time, a rapid cooling (for example, water cooling) can be performed to manufacture the Co-based superelastic alloy material according to the present embodiment. Specifically, the average cooling rate during the rapid cooling is preferably 5° C./s or more. Accordingly, precipitates containing one or two or more of the γ phase, the ε phase, and the σ phase can be reduced to a small amount. Further, the crystal structure of the β phase can be a crystal structure containing one or two or more selected from the group consisting of the A2 type, the B2 type, and the $L2_1$ type. Specifically, when the average cooling rate is 5° C./s or more, the proportion of the B2 phase in the β phase can be 20 vols or more. Further, in order to obtain a microstructure of the β single phase and to further increase the proportion of the B2 type in the crystal structure of the β phase, the average cooling rate during the rapid cooling is more preferably 100° C./s or more. When the average cooling rate during the rapid cooling is 100° C./s or more, the B2 type fine phase less than 10 nm can be obtained. As a result, the superelastic property, the low Young's modulus property, and the workability can be sufficiently ensured. Thus, when the average cooling rate during the rapid cooling is 100° C./s or more, there is no A2 type or $L2_1$ type, or a volume fraction thereof is extremely small, which is preferable. On the other hand, when the average cooling rate during the rapid cooling is less than 100° C./s, a coarse phase of 10 nm or more appears, which contains one or both of the A2 type and the $L2_1$ type and has a volume fraction of less than 80%. Further, precipitates less than 50 volt, which contain one or two or more of the γ phase, the ε phase, and the σ phase, appear from the grain boundary portion of the β phase. Although a relatively favorable superelastic property, a relatively favorable low Young's modulus property, and relatively favorable workability can still be obtained in such a case, such properties are better in the fine phase containing the B2 type. Therefore, the average cooling rate during the rapid cooling is more preferably 100° C./s or more.

On the other hand, when the average cooling rate during the rapid cooling is less than 5° C./s, a coarse phase of 10 nm or more appears, which contains one or both of the A2 type and the $L2_1$ type and has a volume fraction of 80% or more. Further, precipitates of 50 volt or more, which contain one or two or more of the γ phase, the ε phase, and the σ phase, appear both from the grain boundaries and from the inside of the grains of the β phase. As a result, the superelastic property, the low Young's modulus property, and the workability may greatly decrease.

[Properties]

The Co-based superelastic alloy materials according to the present embodiment exhibit the following properties.

<Young's Modulus>

The Co-based superelastic alloy materials according to the present embodiment have a strong elastic anisotropy. That is, the Co-based superelastic alloy materials according to the present embodiment have a strong crystal orientation dependence of Young's modulus. Therefore, the Co-based superelastic alloy materials according to the present embodiment have different Young's moduli depending on crystal orientations. Specifically, in a direction such as the <100> direction, the Young's modulus is close to that of a living bone, which is 10 GPa to 30 GPa. Meanwhile, in directions such as the <110> direction and the <111> direction, a relatively high Young's modulus of 80 GPa to 150 GPa is exhibited with high rigidity. That is, a relatively low Young's modulus is exhibited in the <100> direction or the like, whereas a relatively high Young's modulus is exhibited in the <110> direction, the <111> direction, or the like. Thus, the Young's modulus of the Co-based superelastic alloy materials according to the present embodiment varies depending on the crystal orientation.

The Young's modulus of a living bone is about 10 GPa to 30 GPa. That is, if the Young's modulus of the Co-based superelastic alloy materials can be reduced to the same degree as that of the living bone, the Young's modulus is close to that of the living bone, and, when the Co-based superelastic alloy material is used as a biomaterial such as a bone substitute implant material, stress shielding can be prevented. That is, when a Co-based superelastic alloy material according to the present embodiment is applied to a biomaterial such as a bone substitute implant material, the Young's modulus can be reduced by using a Co-based superelastic alloy in which the <100> direction is dominant among crystal orientations.

On the other hand, a device such as a stent or a guide wire is required to have a high Young's modulus of about 80 GPa to 150 GPa. Therefore, when a Co-based superelastic alloy material according to the present embodiment is applied to a device such as a stent or a guide wire, the Young's modulus can be increased by using a Co-based superelastic alloy in which the <110> direction or the <111> direction is dominant among the crystal orientations.

As described above, for the Co-based superelastic alloy materials according to the present embodiment, there is a correlation between the crystal orientation and the exhibited Young's modulus, and thus different Young's moduli can be exhibited in the same material simply by controlling the crystal orientation. That is, when a Co-based superelastic alloy material according to the present embodiment is used, a Young's modulus according to an application thereof can be exhibited by preparing a Co-based superelastic alloy material with a desired crystal orientation. For example, the Young's modulus can be reduced by forming a <100> orientation single crystal, and the Young's modulus can be increased by forming a <111> orientation single crystal.

In the present embodiment, the Young's modulus of each crystal orientation can be calculated using a strain gauge from the gradient of a stress-strain curve.

Specifically, a single crystal sample having a specific crystal orientation is prepared, a strain gauge is attached thereto, and a stress-strain curve is experimentally determined by a tensile test or a compression test. Based on the gradient of the stress-strain curve for an arbitrary strain, the Young's modulus at the strain is obtained.

<Superelastic Property>

The Co-based superelastic alloy materials according to the present embodiment exhibit stable and favorable superelasticity. Specifically, the superelastic strain is 3% or more, and very large superelasticity can be exhibited.

The term "superelastic strain" in the present embodiment is defined as the amount of strain in the plateau area in a stress-strain diagram as shown in FIG. 6 to be described later. The term "plateau area" as used herein is the area after the elastic deformation area and is the constant stress area after yielding.

<Wear Resistance>

With optimized compositions, the Co-based superelastic alloy materials according to the present embodiment have excellent wear resistance. Therefore, the Co-based superelastic alloy materials can be suitably used as biomaterials. The wear resistance can be improved by optimizing the composition.

<Hot Workability>

The Co-based superelastic alloy materials according to the present embodiment have excellent hot workability in addition to the properties described above. It is considered that this is because of a decrease in the degree of order of the BCC structure.

In the related art, Co—Cr—Al—Si alloys have a favorable superelastic property, but are fairly brittle and thus are not easily worked, leaving room for studies in terms of practical use. However, for the Co-based materials according to the present superelastic alloy embodiment, the contents of Al and Si are reduced, the degree of order of the ordered alloys are reduced, and thus the hot workability can be improved.

[Material (Plate Material and Wire Material)]

The superelastic property of the Co-based superelastic alloy materials may greatly depend not only on the crystal microstructure but also on the size of crystal grains. For example, in the case of a plate material or a wire material, when the average crystal grain size of the crystal grains is equal to or larger than the thickness T of the plate material or the radius R of the wire material, the superelasticity is greatly improved. It is considered that this is because an intergranular constraint force is reduced when the average crystal grain size of the crystal grains is equal to or larger than the thickness T of the plate material or the radius R of the wire material.

<Plate Material>

For a plate material made of the Co-based superelastic alloy material, the average crystal grain size of the crystal grains is preferably equal to or larger than the thickness T of the plate material. For a plate material having such crystal grains, the individual crystal grains are free from the effects of grain boundaries on the surface of the plate material. The plate material having an average crystal grain size equal to or larger than the thickness T exhibits excellent superelasticity because the intergranular constraint force is reduced as in the wire material. In order to further reduce the intergranular constraint force and exhibit excellent superelasticity, the average crystal grain size of the crystal grains in the plate material is more preferably 2 T or more. The average crystal grain size of the crystal grains is more preferably equal to or larger than the width w of the plate material.

A plate material made of the Co-based superelastic alloy material can be used as various spring materials, contact members, clips, and the like by utilizing the superelasticity.

<Wire Material>

For a wire material made of the Co-based superelastic alloy material, the average crystal grain size of the crystal grains is preferably equal to or larger than the radius R of the wire material. In order to further reduce the intergranular constraint force and approach to the behavior of a single crystal, the average crystal grain size of the crystal grains is more preferably 2R or more.

A wire material made of the Co-based superelastic alloy material can be used as, for example, a stent or a guide wire. When the wire material made of the Co-based superelastic alloy material is a thin wire having a diameter of 1 mm or less, a plurality of thin wires may be twisted to form a twisted wire. Further, the wire material can be used as a spring material.

<Method for Manufacturing Plate Material and Wire Material>

A plate material made of the Co-based superelastic alloy materials according to the present embodiment is subjected to hot rolling and is punched and/or pressed into a desired shape. Thereafter, the solution treatment described above can be performed at least once, and a quenching treatment and an aging treatment can be performed as necessary, to manufacture the plate material.

A wire material made of the Co-based superelastic alloy material according to the present embodiment is a wire material obtained by hot forging and drawing. Thereafter, the solution heat treatment described above can be performed at least once, and a quenching treatment and an aging treatment can be performed as necessary, to manufacture the wire material. By performing the same treatment as that for the plate material to prepare the wire material, it is possible to manufacture the wire material in which the crystal grains are coarsened to such an extent that the average crystal grain size is equal to or larger than the radius.

[Use]

Since the Co-based superelastic alloy materials according to the present embodiment can maintain a Young's modulus close to that of a living bone, the Co-based superelastic alloy materials are suitable as biomaterials such as hip implants. In addition, since the Co-based superelastic alloy materials according to the present embodiment have different Young's moduli depending on the crystal orientation, the Co-based superelastic alloy materials can be suitably used as stents, guide wires, or the like by setting the <110> direction, the <111> direction, or the like to be dominant, exhibiting a relatively high Young's modulus.

EXAMPLES

Hereinafter, the present invention will be described in more detail with reference to Examples and Comparative Examples, and the present invention is not limited to the following Examples unless a gist thereof is exceeded.

Raw materials of the alloy materials having compositions shown in Table 1 were melted in an Ar atmosphere by a high-frequency induction melting method, and the melted raw materials were further cast into a mold to prepare rod-shaped samples (φ10 mm). The obtained rod-shaped samples were subjected to hot rolling at 1200° C. to have a plate thickness of 4 mm, and the Co-based superelastic alloy materials were obtained. The hot workability of the Co-based superelastic alloy materials was evaluated as will be described later.

Further, the Co-based superelastic alloy materials formed by hot rolling were subjected to solution treatments. Specifically, each alloy material other than the alloy No. 122 was heated to 1200° C. (solid solution temperature) to form a microstructure thereof into a β single phase, and then subjected to water cooling (average cooling rate: 1700° C./s). The alloy material, i.e., the alloy No. 122 was heated to 1300° C. (solid solution temperature) to form a microstructure thereof into a β single phase, and then subjected to water cooling (average cooling rate: 1700° C./s). The state of the phases after the water cooling and the volume fraction of the β phase are shown in Table 1. In notation of "phase" in Table 1, for example, "β+γ" means that the γ phase having a fraction obtained by subtracting "the volume fraction of the β phase" from 100% (in the case of the alloy No. 105, the γ phase of 26 volt) was observed in addition to the β phase as the main phase.

TABLE 1

| Alloy | Component composition (at. %) | | | | | Volume fraction of | |
|---|---|---|---|---|---|---|---|
| No. | Co | Cr | Al | Si | Phase | β phase | Note |
| 101 | 50 | 38 | 6 | 6 | β | 100% | Example |
| 102 | 50 | 37 | 6.5 | 6.5 | β | 100% | Example |
| 103 | 50 | 35 | 7.5 | 7.5 | β | 100% | Example |
| 104 | 50 | 30 | 10 | 10 | β | 100% | Example |
| 105 | 51 | 36 | 6.5 | 6.5 | β + γ | 74% | Example |
| 106 | 49 | 38 | 6.5 | 6.5 | β | 100% | Example |
| 107 | 48 | 37 | 7.5 | 7.5 | β + σ | 99% | Example |
| 108 | 49 | 36 | 7.5 | 7.5 | β | 100% | Example |
| 109 | 51 | 34 | 7.5 | 7.5 | β | 100% | Example |
| 110 | 52 | 33 | 7.5 | 7.5 | β | 100% | Example |
| 112 | 53 | 32 | 7.5 | 7.5 | β + γ | 54% | Example |
| 114 | 50 | 32 | 6 | 12 | β + σ | 97% | Example |
| 115 | 51.5 | 33.5 | 5 | 10 | β | 100% | Example |
| 116 | 50 | 32 | 7 | 11 | β + γ | 97% | Example |
| 117 | 49 | 37 | 6 | 8 | β | 100% | Example |
| 118 | 52 | 33 | 6.5 | 8.5 | β | 100% | Example |
| 119 | 53 | 32 | 6 | 9 | β + γ | 96% | Example |
| 120 | 51 | 34 | 7 | 8 | β | 100% | Example |
| 121 | 50 | 31 | 9.5 | 9.5 | β | 100% | Example |
| 122 | 49 | 44 | 3.5 | 3.5 | β | 100% | Example |
| 123 | 55.7 | 23.3 | 10.5 | 10.5 | β | 100% | Comparative Example |
| 124 | 55 | 23.5 | 11.5 | 10 | β | 100% | Comparative Example |
| 125 | 56 | 23 | 13 | 8 | β + γ | 73% | Comparative Example |
| 126 | 58 | 17 | 13.5 | 11.5 | β | 100% | Comparative Example |
| 127 | 55 | 20 | 13.5 | 11.5 | β | 100% | Comparative Example |
| 128 | 50 | 25 | 11 | 14 | β | 100% | Comparative Example |
| 129 | 53 | 39 | 3 | 5 | γ + σ | 0% | Comparative Example |

(Hot Workability)

Among the alloy materials shown in Table 1, the hot workability of alloy materials shown in Table 2 was evaluated. Table 2 shows evaluation results of the hot workability. For the hot rolling, the samples being able to reach a rolling reduction ratio of 60% or more was evaluated as "o" (passed), and a sample not being able to reach such a rolling reduction ratio was evaluated as "x" (failed).

As shown in Table 2, for all of alloys No. 124 to No. 129 that are Comparative Examples, cracking occurred during the hot rolling, and the rolling could not be performed up to the rolling reduction ratio of 60%. On the other hand, all of alloy materials in Examples of the present invention could go through the hot rolling without cracking.

TABLE 2

| Alloy No. | Hot workability | Note |
|---|---|---|
| 105 | ○ | Example |
| 106 | ○ | Example |
| 107 | ○ | Example |
| 108 | ○ | Example |
| 109 | ○ | Example |
| 110 | ○ | Example |
| 112 | ○ | Example |
| 115 | ○ | Example |
| 116 | ○ | Example |
| 117 | ○ | Example |
| 118 | ○ | Example |

TABLE 2-continued

| Alloy No. | Hot workability | Note |
|---|---|---|
| 119 | ○ | Example |
| 120 | ○ | Example |
| 124 | x | Comparative Example |
| 125 | x | Comparative Example |
| 126 | x | Comparative Example |
| 127 | x | Comparative Example |
| 128 | x | Comparative Example |
| 129 | x | Comparative Example |

(Microstructure Observation and Identification of Crystal Structure)

FIGS. 2 and 3 show results (TEM photographs) of TEM observation of the alloy No. 120. FIG. 2 is a diffraction pattern (selected area diffraction pattern) obtained when the electron beam is incident in the [01-1] direction of the main phase (β phase). In FIG. 3, (a) to (d) are electron microscope images of the alloy No. 120. In FIG. 3, (a) is a bright field image obtained using the transmission spot, and (b) is a dark field image obtained using the 111 diffraction spot in the same field of view. In FIG. 3, (c) is a bright field image obtained using the transmission spot at another observation location, and (d) is a dark field image obtained using the 200 diffraction spot in the same field of view.

From the selected area diffraction pattern of [01-1] incidence in the main phase (β phase) shown in FIG. 2, it is seen that the main phase of the alloy No. 120 has a BCC structure. Further, in FIG. 2, since the intensity of the 111 diffraction spot is very weak, it is predicted that a decrease in the degree of order of the BCC structure contributes to the excellent hot workability.

(Multiphase Formation of Metallographic Structure)

Next, for each of the alloys No. 101 to No. 104, No. 120, and No. 121, the solution heat treatment was performed, and then the alloy was cooled to a temperature shown in Table 3 (a temperature range where multiphase was formed) at an average cooling rate of 5° C./min and then held for 60 minutes to form multiphase in the metallographic structure.

As a result, as shown in Table 3, it was confirmed that a metallographic structure of two phases or three phases was obtained in the alloy material after cooling to the temperature range in which two phases or three phases were formed and holding.

TABLE 3

| Alloy No. | Temperature (° C.) | Phase | Note |
|---|---|---|---|
| 101 | 1100 | β + γ | Example |
| 102 | 600 | β + σ + γ | Example |
| 103 | 800 | β + σ + γ | Example |
| 104 | 1100 | β + σ | Example |
| 120 | 800 | β + σ + γ | Example |
| 121 | 600 | β + σ | Example |

(Preparation of Coarse Grains)

Next, the solution heat treatment was performed using the alloy No. 120, and then a crystal grain coarsening step (cyclic heat treatment) having a temperature profile as shown in FIG. 4A was performed to prepare coarse grains. Specifically, after the heat treatment in the dotted line area shown in FIG. 4A was repeated 11 times, for the case of Sample 1, the heat treatment was performed at 800° C. for 1 hour in the twelfth cycle and then quenching was performed, and, for the case of Sample 2, the heat treatment was performed at 800° C. for 1 hour in the twelfth cycle, then the temperature was increased to 1200° C. and quenching was performed. Next, each of Sample 1 and Sample 2 was polished and then observed by an electron backscatter diffraction (EBSD) method. Observation results obtained by EBSD are shown in FIG. 4B.

As shown in FIG. 4B, it is seen that Sample 1 has a four-phase structure containing the β phase (BCC), which is the parent phase, the σ phase, the γ phase, and the & phase transformed by cooling from the γ phase. From the orientation deviation map (GROD map), it can be seen that strain occurs in Sample 1 in the parent phase between precipitates.

On the other hand, as shown in FIG. 4B, it can be seen that Sample 2 contains the β single phase, which is the parent phase. However, it is observed that subgrain boundaries are formed within the crystal grains, and it is predicted that the subgrain boundaries are formed by strain introduced by precipitates.

(Plate Material)

A plate material having a thickness of 1.5 mm, a width of 8 mm, and a length of 70 mm was cut out from the hot-rolled alloy No. 120 and subjected to a cycle heat treatment (dotted line area) shown in FIG. 5A. Thereafter, the plate material after the cyclic heat treatment was subjected to a solution heat treatment at 1200° C. for 8 hours and then quenched in water (W.Q.) (see FIG. 5A).

After the observation by EBSD on the cross-section parallel to the plate surface in the plate material after the quenching, as shown in FIG. 5B, it was observed that crystal grains were coarsened, and a part of the crystal grains grew to such an extent that a single crystal was formed. In FIG. 5B, the single crystal is shown in dark gray.

As shown in FIG. 5B, it was confirmed that the average crystal grain size of the plate material using the alloy No. 120 was equal to or larger than the thickness (1.5 mm) of the plate material. This is expected to be due to abnormal grain growth driven by the formed subgrain boundaries as in a Cu—Al—Mn alloy material in the related art.

It is seen that a single crystal material can be prepared relatively easily by the above method.

(Single Crystal)

The alloys No. 115 and No. 117 to No. 120 as Examples of the present invention and the alloys No. 123 to No. 125 as Comparative Examples were subjected to the cyclic heat treatment shown in FIG. 5A after the solution heat treatment. Thereafter, analysis was performed by EBSD, and single crystallization was evaluated. An alloy in which a single crystal having an average crystal grain size of 1 cm or more was obtained was evaluated as "o" (passed), and an alloy in which such a single crystal was not obtained was evaluated as "x" (failed). Evaluation results are shown in Table 4.

(Superelastic Property)

In the same way as in the evaluation of the single crystallization, the alloys No. 115 and No. 117 to No. 120 as Examples of the present invention and 123 to 125 as Comparative Examples were subjected to the cyclic heat treatment shown in FIG. 4A. For each obtained sample, the superelastic property was examined using a stress-strain curve.

After the measurement of the stress-strain curve for the single crystal sample obtained from the alloy No. 118, superelasticity as shown in FIG. 6 was confirmed. In addition, superelasticity was confirmed in the same way also in other Examples of the present invention (alloys No. 117 to No. 120).

Further, for a sample having the <100> orientation toward the tensile direction, the superelastic strain εSE was about 14%, and the total strain Et was 17%. Such a strain is twice or more as compared with that (see the stress-strain curve "Ti—Ni RANDOM" on the lower left side in FIG. 6) of a Ti—Ni alloy as a practical material (a material in the related art) and is about four times as compared with the amount of deformation of a β—Ti-based shape memory alloy (Ti—Nb—Ta—Zr alloy) (see the stress-strain curve "Ti—Nb—Ta—Zr <101> TEXTURED" on the lower right side in FIG. 6).

FIG. 7A shows the orientation dependence of the superelastic property of the single crystal samples obtained from the alloy No. 120. For the sample in the <110> orientation, the critical stress increased and the amount of deformation strain decreased as compared with the sample in the <100> orientation. On the other hand, in the <111> orientation, since the critical stress exceeded the fracture stress of the material, no superelasticity was obtained.

Regarding the superelastic property and the orientation dependence, favorable results similar to those of the alloys No. 118 and No. 120 were obtained in the alloys No. 115, No. 117, and No. 119 as Examples of the present invention. However, in each of the alloys No. 123 to No. 125 as Comparative Examples, a single crystal could not be prepared as shown in Table 4; instead, a polycrystal was formed, and thus the superelastic property was not obtained due to grain boundary fracture.

Here, the stress-strain curve (S-S curve) in each Example was obtained as follows. First, a tensile test specimen having dimensions shown in FIG. 7B was subjected to a tensile test with stress loading and unloading twice to obtain the stress-strain curve.

TABLE 4

| Alloy No. | Single crystal | Superelasticity | Note |
|---|---|---|---|
| 115 | ○ | ○ | Example |
| 117 | ○ | ○ | Example |
| 118 | ○ | ○ | Example |
| 119 | ○ | ○ | Example |
| 120 | ○ | ○ | Example |
| 123 | x | x | Comparative Example |
| 124 | x | x | Comparative Example |
| 125 | x | x | Comparative Example |

(Elastic Deformation Property)

The alloys No. 118 and No. 120 were subjected to the cyclic heat treatment shown in FIG. 5A to prepare single crystal samples. The measurement was conducted on the elastic deformation area of each single crystal using a strain gauge to obtain a stress-strain curve (FIG. 8A).

For the single crystal samples having the <100> orientation toward the tensile direction, the elastic deformation of the alloy No. 120 was about 4.5%, and the elastic deformation of the alloy No. 118 was about 2.5%, which exhibited fairly large elastic deformation as compared with a usual metal material. In addition, in each alloy of the alloys No. 118 and No. 120, martensite transformation occurred after usual elastic deformation, and superelasticity was exhibited.

Further, when the Young's modulus was calculated based on a differential value of the stress-strain curve (FIG. 8A) for each of the single crystal samples of the alloy No. 118 and No. 120 according to JIS Z 2280, as shown in FIG. 8B, the Young's modulus was about 10 GPa to 30 GPa, i.e., a low Young's modulus fairly close to that of a living bone.

FIG. 9 shows the stress-strain curves of the single crystal samples obtained from the alloy No. 120 and the relationship between the Young's modulus and strain obtained from the stress-strain curves. As shown in FIG. 9, the Young's modulus of the alloy No. 120 as Example of the present invention varies depending on the orientation, and samples near <110> and near <111> exhibited high values of 80 GPa and 120 GPa, respectively. It is predicted that a higher Young's modulus can be obtained by further bringing the orientation closer to the <111> direction.

(Wear Property)

Next, for the alloys No. 118 and No. 120 after the solution treatment before the cyclic heat treatment, ball-on-disc wear tests were performed to evaluate the wear property.

Specifically, first, a sample having a thickness of 5 mm was cut out, a super-hard ball (tungsten carbide ball) having a diameter of 3/16 in (4.7625 mm) was used as a counter material, and the wear test was performed by pressing the counter material with a load of 3 kg and sliding on a circumference having a wear radius of 3 mm at a speed of 50 mm/s for 1 hour.

As Comparative Examples, a Co—Cr—Mo alloy (alloy No. 130), SUS316L (alloy No. 131), CP—Ti (alloy No. 132), and a Ti-6Al-4V alloy (alloy No. 133), mainly used as metallic biomaterials, were subjected to the same test.

FIG. 10 shows the photographs of wear tracks after the wear tests and photographs of the cross-sections thereof. It is seen that the alloys No. 118 and No. 120 are slightly inferior to the Co—Cr—Mo alloy (alloy No. 130) having excellent wear resistance, but the wear loss of each of the alloys No. 118 and No. 120 is fairly small as compared with SUS316L (alloy No. 131), the Ti-6Al-4V alloy (alloy No. 133), and CP—Ti (alloy No. 132).

In addition, the specific wear factor (wear volume/sliding distance/load), i.e., the amount of wear loss per unit load, was obtained as the wear property. Specifically, the wear volume was computed from the cross-sectional area and the wear radius using the cross-sectional image shown in FIG. 10, and the specific wear factor was calculated using the wear volume, sliding distance, and load.

The unit of the specific wear factor shown in Table 5 is "$\times 10^{-8}$ ($mm^2/N$)".

TABLE 5

| Alloy No. | Specific wear factor*1 | Note |
|---|---|---|
| 118 | 7.8 | Example |
| 120 | 6.55 | Example |
| 130 | 3.42 | Comparative Example |
| 131 | 44.5 | Comparative Example |
| 132 | 98.6 | Comparative Example |
| 133 | 58.7 | Comparative Example |

*1Specific wear factor [$\times 10^{-8}$ ($mm^2/N$)]

(Crystal Structure of β Phase)

Next, the influence of average cooling rate in the cooling step after the solution treatment on the crystal structure of β phase was examined using the alloy No. 120. Specifically, first, the alloy No. 120 was heated to 1200° C. (solid solution temperature) to form a microstructure of β single phase and then cooled at average cooling rates shown in Table 6. The state of phases after the cooling, the volume fraction of the β phase, and the proportion (vol %) of the B2 phase in the β phase are shown in Table 6. In notation of "Phases" in Table 6, for example, "β+γ+σ" means that the (γ+σ phase) having a fraction obtained by subtracting "the volume fraction of the β phase" from 100% was observed in addition to the β phase as the main phase.

As shown in Table 6, as the average cooling rate in the cooling step was increased, the proportion of the B2 phase in the β phase was increased. In all of Examples of the present invention in which the average cooling rate was 5°

C./s or more, an excellent superelastic property and excellent workability were exhibited. On the other hand, in all of Comparative Examples in which the average cooling rate was less than 5° C./s, the superelastic property and the workability were poor.

TABLE 6

| Alloy No. | Average cooling rate (5° C./s) | Phases | Volume fraction of β phase | Volume fraction of B2 phase in β phase | Note |
|---|---|---|---|---|---|
| 120 | 1700 | β | 100% | 100% | Example |
| 120 | 18 | β + γ + σ | 86% | 91% | Example |
| 120 | 6 | β + γ + σ | 67% | 54% | Example |
| 120 | 3 | β + γ + σ | 46% | 15% | Example |
| 120 | 0.16 | β + γ + σ | 17% | 9% | Example |

The invention claimed is:

1. A Co-based superelastic alloy material comprising:

a Co—Cr—Al—Si-based alloy, wherein the Co-based superelastic alloy material has a composition (at. %) within a pentagon area on the Co—Cr—(Al,Si) pseudo-ternary phase diagram, and containing Al: 2.5 at. % to 10.0 at. % and Si: 2.5 at. % to 13.0 at. %, the pentagon area being formed of five points of point A: $CO_{49.5}Cr_{27.5}$ $(Al,Si)_{23}$, point B: $Co_{57}Cr_{27.5}$ $(Al,Si)_{15.5}$, point C: $Co_{50}Cr_{45}$ $(Al,Si)_5$, point D: $Co_{45}Cr_{45}$ $(Al,Si)_{10}$, and point E: $Co_{45}Cr_{32}$ $(Al,Si)_{23}$.

2. The Co-based superelastic alloy material according to claim 1, wherein the main phase of the metallographic structure is a β phase having a BCC structure.

3. The Co-based superelastic alloy material according to claim 2, wherein the volume ratio of the β phase having a BCC structure is 50% or more.

4. The Co-based superelastic alloy material according to claim 2, wherein, in addition to the main phase, one or two or more selected from a group consisting of a γ phase having an FCC structure, an ε phase having an HCP structure, and a σ phase is contained in an amount of 50 vol % or less in total.

5. The Co-based superelastic alloy material according to claim 2, wherein the crystal structure of the β phase is formed of one or two or more selected from a group consisting of an A2 phase, a B2 phase, and an $L2_1$ phase.

6. The Co-based superelastic alloy material according to claim 2, wherein the proportion of the B2 phase in the β phase is 20 vol % or more.

7. A plate material comprising:

the Co-based superelastic alloy material according to claim 1, wherein the Co-based superelastic alloy material has an average crystal grain size equal to or larger than the thickness of the plate material.

8. A wire material comprising:

the Co-based superelastic alloy material according to claim 1, wherein the Co-based superelastic alloy material has an average crystal grain size equal to or larger than the radius of the wire material.

9. A Co-based superelastic alloy material manufacturing method for manufacturing the Co-based superelastic alloy material according to claim 1, comprising:

a solution heat treatment step of performing a heat treatment at 1100° C. to 1400° C.

10. The Co-based superelastic alloy material manufacturing method according to claim 9, further comprising:

a cooling step of performing cooling to room temperature at an average cooling rate of 5° C./s or more after the solution heat treatment step.

11. The Co-based superelastic alloy material manufacturing method according to claim 9, further comprising:

a crystal grain coarsening step of repeatedly performing a heat treatment in a temperature range where a β single phase is formed, and a temperature range where two phases of β phase+γphase or βphase+σ phase are formed or a temperature range where three phases of βphase+γphase+σ phase are formed between the solution heat treatment step and the cooling step.

12. The Co-based superelastic alloy material manufacturing method according to claim 11, wherein the temperature range where the β single phase is formed is 1100° C. to 1400° C., and the temperature range where the two phases are formed or the temperature range where the three phases are formed is 700° C. to 1100° C.

13. A guide wire comprising:

a material containing the Co-based superelastic alloy material according to claim 1.

14. A stent comprising:

a material containing the Co-based superelastic alloy material according to claim 1.

15. A hip implant comprising:

a material containing the Co-based superelastic alloy material according to claim 1.

* * * * *